US006047143A

United States Patent [19]

Larson et al.

[11] Patent Number: 6,047,143

[45] Date of Patent: Apr. 4, 2000

[54] SYSTEMS AND METHOD FOR ADJUSTING IMAGE DATA TO COMPENSATE FOR CROSS-CONTAMINATION

[75] Inventors: James R. Larson; George A. Gibson, both of Fairport; Edward B. Caruthers, Jr., Rochester; Raymond W. Stover, Webster, all of N.Y.

[73] Assignee: Xerox Corporation, Stamford, Conn.

[21] Appl. No.: 09/233,093

[22] Filed: Jan. 19, 1999

[51] Int. Cl.[7] ..... G03G 15/00; G03G 15/01; G03G 15/10; G03G 15/04

[52] U.S. Cl. ..... 399/29; 358/1.9; 358/518; 399/39; 399/54; 430/43

[58] Field of Search ..... 399/28, 29, 38, 399/39, 40, 43, 54, 57, 233; 358/1.9, 518, 523; 430/43

[56] References Cited

U.S. PATENT DOCUMENTS

| | | | |
|---|---|---|---|
| 4,078,929 | 3/1978 | Gundlach . | |
| 5,539,522 | 7/1996 | Yoshida | 358/296 |
| 5,722,017 | 2/1998 | Caruthers, Jr. et al. | 399/238 |
| 5,897,239 | 4/1999 | Caruthers, Jr. et al. | 399/54 |

*Primary Examiner*—Joan Pendegrass
*Attorney, Agent, or Firm*—Oliff & Berridge, PLC

[57] ABSTRACT

An image data adjustment system is described which adjusts image data to be printed based upon the level of contaminants detected in the toner reservoirs. The system detects the level of contamination of a toner to be printed and adjusts the image data so that a compensating toner is also printed with the desired toner so that an intended print color is achieved despite contaminants in the toner.

28 Claims, 8 Drawing Sheets

SYSTEMS AND METHOD FOR ADJUSTING IMAGE DATA TO COMPENSATE FOR CROSS-CONTAMINATION

BACKGROUND OF THE INVENTION

1. Field of Invention

This invention relates to liquid toner development of latent electrostatic images. More particularly, this invention relates to liquid toner development systems and methods that are capable of modifying image data to compensate for detected impurities in the toners.

2. Description of Related Art

Digital color printing devices, such as ink jet printers, ionographic printers, laser printers, copiers and the like, receive image data, which may be internally or externally generated, in the form of signals to print specified colors in specified areas. Process color printers print all specified colors as some combination of halftone patterns of the four process colors, cyan, magenta, yellow and black, conventionally labeled C, M, Y and K. Many kinds of digital printer control systems are known. The input color can be specified as a combination of red, green and blue values (R, G, B values) such as are used in computer monitor displays, by a unique identification number (such as a number from the Pantone® Color Matching System), by color space coordinates (such as CIELAB's L* a* b* coordinates), or by other color specification systems. The specification of the input color can also be provided as a set of percent area coverages for the four process color. The digital printer control system converts the input color to an on-off pattern for each of the process colors. The digital printer control system can use look-up tables or formulas or multi-step algorithms to determine the halftone process colors patterns that best reproduce each input color. These halftone patterns can take the form of lines and spaces between the lines or, more commonly, dots and spaces between the dots. When the on-off patterns specify dots and spaces between dots, the dots can be round, oval, or even polygonal. The pattern of dots can be regular or random. The same methods used for converting color areas to process color halftone patterns may also be used in offset, gravure, letterpress and other printing systems to produce printing plates, printing cylinders and the like for the process colors. The digital printer control system finally converts the on-off process color patterns into on-off signals for a device which will construct the process color patterns. In many digital printing systems a single halftone dot is produced from a set of smaller dots.

A typical electrostatographic printing machine employs a photoconductive member that is sensitized by charging the photoconductive member to a substantially uniform potential. The charged portion of the photoconductive member is image-wise discharged by light to form a latent image of an original image on the photoconductive member. Exposing the charged photoconductive member with light selectively dissipates the charge to form the latent image on the charged photoconductive member. The latent image recorded on the photoconductive member is developed using a developer material. The developer material can be a liquid developer material known in the literature as "liquid electrophoretic ink" or simply "liquid ink" or "liquid xerographic toner" or simply "liquid toner". In a liquid development system, the photoconductive surface is contacted by liquid developer material comprising finely divided toner particles dispersed in an insulating liquid carrier. The latent image attracts the toner particles dispersed throughout the insulating liquid carrier material particles to the photoconductive surface to develop the latent image, thus forming a visible image.

Liquid toners have many advantages and often produce images of higher quality than images formed with powder toners. For example, images developed with liquid toner may adhere to the copy substrate without requiring fixing or fusing to the copy substrate. Thus, the liquid toner may not need to include a resin for fusing purposes. In addition, the toner particles suspended in the liquid carrier material can be made significantly smaller than the toner particles used in powder toners. Using such small toner particles is particularly advantageous in multicolor processes where multiple layers of toner particles generate the final multicolor output image. An additional advantage of liquid toners is that the particles are charged by a controlled chemical reaction between the sites on the particle surface and molecules dissolved in the liquid carrier material. This charging makes possible liquid toner particles with 20–50% pigment, instead of the 2–10% pigment which is common in dry toner particles. This increased pigment loading reduces the amount of resin contained in the image transferred to the final printed substrate. This reduced resin reduces paper curl and leads to multicolor output images which generally have a significantly more uniform finish compared to images formed using powder toners.

Liquid toners typically contain about 1–5% by weight of fine solid particulate toner material disbursed in the liquid carrier material. The liquid carrier material is typically a hydrocarbon. After developing the latent electrostatic image, the developed image on the photoreceptor may contain 6–25% by weight of the solid particulate toner particles along with residual liquid hydrocarbon carrier. To complete the development process, the solid particulate toner material is typically compacted onto the photoreceptor and the excess liquid carrier material removed from the photoreceptor.

Liquid toner development systems are generally capable of very high image resolution because the toner particles can safely be ten or more times smaller than dry toner particles. Typical dry toner particles are on the order of 10 microns in diameter. Typical liquid toner particles are on the order of 1 micron in diameter. Liquid toner development systems show impressive grey scale image density response to variations in image charge and achieve high levels of image density using small amounts of liquid developer. Additionally, the systems are usually inexpensive to manufacture and are very reliable.

SUMMARY OF THE INVENTION

Conventional reproduction processes as described above can be adapted to produce multicolor images by altering the basic process in some manner. For example, the charged photoconductive member may be sequentially exposed to a series of color-separated images of the original image to form a plurality of latent images. Each latent color-separated image is then developed with a developing material containing a complementary-colored toner that is the subtractive complement of the color-separated image. Thereafter, the developed color-separated images are superimposed in registration with one another to produce a multi-color image. The fidelity of the final output image produced by this technique is dependent, to a large extent, on how well the subtractive color toners mix or combine, when brought together, to reflect the colors found in the original image.

Conventional electrostatographic imaging techniques previously directed to forming monochrome images have also been extended to create highlight color images, where independent, differently-colored monochrome images are created on an output copy sheet. One exemplary highlight color process is described in U.S. Pat. No. 4,078,929 to Gundlach, where independent images are created using a raster output scanner to form a tri-level image, including a pair of charge patterns having different potential values corresponding to different image areas and a non-image background area generally having a potential value between the potentials of the two image areas. As disclosed in the 929 patent, each charge pattern is developed with toner particles of a first or second color. Among other advantages, this process allows for faithfull color reproduction, using so-called custom colors, since the color of each image is directly related to the color of the toner particles deposited on the photoreceptor for each image, and does not depend on the mixture of subtractive color toners to produce the desired color output image.

As previously noted, conventional electrostatographic imaging processes have also been modified to use liquid developing materials. The liquid-developing-material-based systems have numerous advantages, as outlined above. In addition, with particular regard to multicolor imaging, liquid developing materials have been shown to be economically attractive, particularly if surplus liquid carrier can be economically recovered without cross contaminating the differently colored toners. Further, full color output images made with liquid developing materials can provide much higher fidelity due to the very small toner particles, and can be processed to a substantially uniform finish. In contrast, uniform finishes are difficult to achieve with powder toners due to various factors, including variations in the toner pile height.

One of the key issues associated with multicolor imaging processes, and, in particular, with so-called image-on-image processes, is contaminating downstream developing material supply reservoirs of one color toner with differently-colored toner particles from previously developed, or upstream, images. That is, toner of a first color applied to the photoreceptor to produce a first color developed image may separate, or "detone", from the photoreceptor during subsequent processing. This detoned toner may become captured or retrieved during direct development of a subsequent color toner, such that the first color toner particles become incorporated into, and contaminate, the toner particles of a different, downstream, color.

Downstream color images, i.e., later developed color images, can be contaminated by detoned toner from upstream color images, i.e., color images developed earlier, in multi-color printer architectures. In image-on-image (IOI) development systems, all color images are developed onto a single region of a single photoreceptor. That is, after a previous color image is developed onto a region of the photoreceptor, each next latent color image is written, and each next color image is developed, onto the same region of the photoreceptor. Detoned toner from the upstream color image thus can contaminate the downstream color toner reservoirs. One example of IOI development systems is the Xerox ColorgrafX 8954 and similar electrostatic printers, where a dielectric paper is image-wise charged with a first color image, liquid toner is applied to develop the first color image, the first color image is dried, and the foregoing processes are repeated for a second, a third and a fourth color image. In a second example of IOI development systems, a photoreceptor belt is uniformly charged, then imagewise discharged with a first color image. The first color image is developed with a first color liquid toner. The first color image is dried and these processes are repeated for a second color, a third color and a fourth color image. Finally, the four color image is transferred to a final substrate, most commonly paper.

If, instead of an IOI development system, a tandem multicolor development system is used, each color is developed onto its own photoreceptor or dielectric member and the single color images are subsequently transferred (a) to a substrate, or (b) to an intermediate belt for subsequent transfer to the final substrate. Even in this case, toner from an upstream color image can back-transfer to a member to which a downstream color toner or image is transferred. This leads to contamination of a downstream color toner reservoir unless the drum or belt used to form that downstream color image is thoroughly cleaned with a separate cleaning fluid between the transfer step and the next development step. Such cleaning increases marking engine's complexity and cost.

It has been found that, even at very low contamination levels, a downstream toner reservoir may become sufficiently contaminated with upstream toner materials over time such that an unacceptable color shift in the downstream toner occurs.

Clearly, such contamination degrades the color quality of output copies and results in a significant reduction in the useful life of the developer material. This, in turn, generates increased frequency in service calls due to copy quality dissatisfaction and frequently results in the premature replacement of the developer material. While this wasteful practice may be justifiable in some situations where copy quality can be restored, it is desirable to minimize or eliminate the issue of developer material contamination to reduce the number and cost of service calls by extending the useful life of the developer materials. Thus, it is desirable to provide a system that compensates for color contamination in developer reservoirs to reduce operator intervention, which results in machine downtime, and to reduce waste in the form of developing materials, as well as unacceptable output copy quality.

This invention provides systems and methods for adjusting color image data for a multi-color image to compensate for contamination of toner of one color into the liquid developer material of a second color. This invention provides a digital printer control system that uses at least one sensor to measure the contamination of the printing inks or toners and that further includes look-up tables, formulas and/or algorithms which are used to generate modified halftone patterns for the printed colors, including their color shift due to contamination, such that the actual printed colors best approximate the specified input color. Most generally, this invention provides systems and methods of modifying the patterns of printed colors to compensate for color contamination of one or more of the printing inks or toners.

This invention separately provides systems and methods for detecting cases of contamination that are too great for its compensation methods to print acceptable matches to the input color. In such cases, the control system can signal the user to replace the contaminated ink or toner supply. Alternatively, the control system of this invention can cause valves to open so that some of the contaminated ink or toner is removed to a waste container and replaced by ink or toner concentrate. Methods for such removal and replenishment are described in commonly assigned U.S. Pat. No. 5,722,017 and are incorporated herein by reference.

This invention separately provides systems and methods that determine an amount of toner of a first color contaminating a toner of a second color, and that adjusts the amounts of the first and second color toners applied to a same image area to compensate for the amount of the first color toner in the second color toner.

This invention separately provides systems and methods that determine an amount of a first color toner contaminating a second toner, and that adjusts an amount of a third color toner complementary to the first color toner and an amount of the second color toner to be applied to the same image area when the first color toner and the second color toner are not applied to that same image area.

This invention further provides systems and methods, that, when the same image areas that contain the contaminated toner but do not contain the contaminating color also contain a fourth toner, adjusts an amount of the fourth toner applied to that same image area.

Therefore, in accordance with one exemplary embodiment of the systems and methods of this invention, image areas containing both a contaminating toner and toner contaminated with the contaminating toner are identified. In these image areas, the amount of contaminating toner applied to the identified image areas is reduced. At the same time, the amount of contaminated toner is increased. For example, if the printing order is cyan, magenta, yellow and black (C, M, Y, K) and the yellow toner reservoir is contaminated with a few percent of the cyan toner, then the contaminated yellow toner reservoir contains less yellow toner and more cyan toner than it should. Thus, it is desirable to increase the amount of the cyan-contaminated yellow toner and decrease the amount of the uncontaminated cyan toner in the image areas that contain both cyan and yellow toners in order to print a green image having the correct amounts of cyan and yellow toner. Thus, in the systems and methods according to this invention, in one example, a greater amount of cyan-contaminated yellow toner and a lesser amount of cyan toner is applied to the "green" image areas to achieve a proper green color.

As a first numerical example, if the yellow toner supply unit is contaminated with n % cyan toner, then it contains [100−n]% yellow toner and n % cyan toner To compensate for this contamination in an image area that should contain x % cyan toner and y % yellow toner, the control system could modify the image data to indicate that [y/(100−n)]% yellow toner and [x−(n*y)/(100−n)]% cyan toner should be applied to these areas. In this way, the image area will contain y % yellow toner and x % cyan toner. Although this example over-simplifies the color additivity, it will come closer to the desired print color than using no adjustment. It should be understood that other, more complex, compensation formulas can be found, either empirically or by using detailed color models which include effects of halftone dots to control the color perceived by an observer of the print.

In a second exemplary embodiment of the systems and methods according to this invention, image areas are identified that contain the contaminated toner but do not contain the contaminating toner. In these identified image areas, the image data is adjusted to include a toner that complements the contaminating color. At the same time, if the image data indicates that black toner is to be added to that region, the image data is adjusted so that the amount of black toner that would have been added to these areas is correspondingly reduced. For example, the printing order is C, M, Y, K and the yellow toner reservoir is contaminated with a few percent of cyan toner. Then, for areas that contain yellow toner but do not contain cyan toner, such as yellow, orange and red image areas, the systems and methods of this invention modify the image data to print a few percent of magenta toner (or to print a few extra percent of magenta toner) in those image areas. The extra magenta toner partially compensates for the cyan contamination because magenta and cyan are somewhat complementary colors. The combination of magenta toner and cyan toner shifts the hue of the printed color to the desired value. However, the combination of yellow, cyan and magenta toners forms process black, so that the contamination and the compensation make the printed color darker than desired. If the compensated image areas also contain black toner, then further modifying the image data to reduce the amount of black toner compensates for this darkening.

As a second numerical example, consider an image area in which we desire to print a combination of magenta, yellow and black. If the yellow toner supply unit is contaminated by n % cyan, then it contains [100−n]% yellow toner and n % cyan toner. The control system may modify the image data for image areas that would normally contain x % magenta toner, y % yellow toner and z % black toner to contain [x+x']% magenta toner, [y+y']% contaminated yellow toner and [z−z']% black toner. If we assume that one part of cyan plus one part of magenta plus one part of yellow prints the same as one part of black, then to make the excess yellow that is actually printed equal the cyan contaminant, y'=(2*y*n)/(100%−n). To make the excess magenta equal the cyan contaminant, x'=n*[y+(2*y*n)/(100−2*n)]. And to make the reduction in black equal the cyan contaminant, z'=n*[y+(2*y*n)/(100−2*n)]. This example oversimplifies the color additivity, but it comes closer to the desired print color than no adjustment. It will again be recognized that this simple exemplary relationship between cyan, magenta, yellow and black may be replaced by more accurate empirical or theoretical relationships without departing from the essence of the invention.

In one preferred embodiment of the systems and methods of this invention, a look-up table contains empirically-determined adjustments to the image data for each combination of contaminating and contaminated toners for each desired color.

These and other advantages of the invention are described in or are apparent from the following detailed description of the preferred embodiments.

BRIEF DESCRIPTION OF THE DRAWINGS

The preferred embodiments of the invention will be described in detail, with reference to the following figures in which.

DETAILED DESCRIPTION OF PREFERRED EMBODIMENTS

Figure 1:
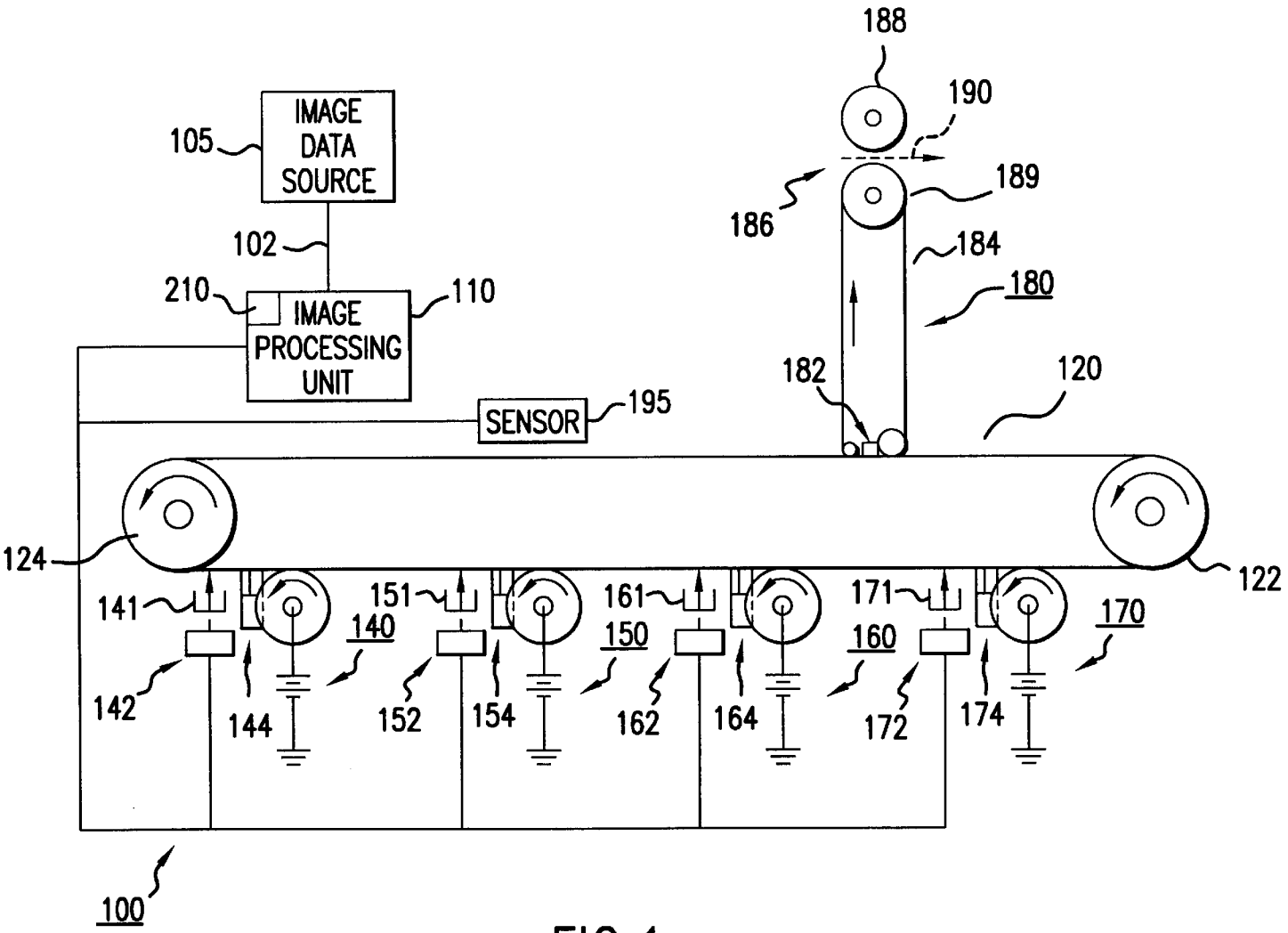
FIG. 1 shows a schematic elevational view of an exemplary liquid development system.

FIG. 1 shows a conventional image-on-image, multicolor liquid developing material-based electrostatographic printing system 100 that can incorporate the image data adjusting systems and methods of the invention. The image data adjusting systems and methods according to the invention may also be used in a wide variety of printing systems and are not limited to the particular single-pass, image-on-image multicolor system described below.

The printing system 100 is connected to an image data source 105. The image data source 105 can be any known system for obtaining or supplying image data. For example, the image data source 105 may include a scanning assembly that includes a light source, mirrors, lenses and charge-coupled devices (CCDs). The image data source 105 may also be a computer that supplies images previously stored or generated in a computer. The image data source 105 may supply images as a series of C, M, Y and K images. Alternatively, the image date source 105 may supply images as a series of Red, Green and Blue images. The image data source may also supply identifying numbers for parts of the image to identify areas to be printed in special colors, such as those supplied by the Pantone® Color Matching System. The image data source 105 is coupled to an image processing unit 110 by a link 102. The image processing unit 110 alters the image data from the image data source 105 to produce a set of on-off signals to the exposure sources 142, 152, 162 and 172 of the C, M, Y, K development stations, 144, 154, 164 and 174. The image processing unit 110 also includes an image data adjusting system 210 according to this invention, which adjusts the image data based upon the level of toner contamination.

At least one sensor 195 is also provided to detect the level of contamination for each toner reservoir. The at least one sensor 195 may be a number of spectrophotometric sensors located in each color supply housing which measure the color of the toner in each housing. Sensors that detect toner volume, toner solids concentrations and toner conductivity may also be employed to provide the toner contamination information.

Alternatively, the at least one sensor 195 may provide the contamination information based upon a last printed image or a printed test pattern. A single test pattern can be formed on the surface of a photoreceptor 120. The image data values for the image to be printed can then be adjusted based upon the toner colors printed in the test pattern or the last printed image.

The printing system 100 also includes a photoreceptor belt 120 that is rotated along a curvilinear path defined by a pair of rollers 122 and 124. The photoreceptor belt 120 receives and holds a charge until it is exposed to light.

The printing system 100 uses a Recharge, Expose and Develop (ReaD) process, where the charged photoconductive surface of the photoreceptor belt 120 is serially charged, exposed and developed to record latent images. As described above, the color separated image values are obtained from the image processing unit 110 as on-off signals for the C, M, Y, K development stations, 144, 154, 164 and 174. The latent images are then serially developed with appropriately colored toner particles until all of the different color toner layers are deposited on the photoreceptor belt 120. This is accomplished by transmitting the color separated image values for each pixel of the original image to a series of individual image forming stations 140, 150, 160 and 170.

The image forming stations 140, 150, 166 and 170 include charging devices, 141, 151, 161, and 171 which uniformly charge or recharge the photoreceptor belt. imaging devices 142, 152, 162, and 172 which write the image data onto the charge photoreceptor belt 120. The imaging devices 142, 152, 162 and 172 write the image onto the photoreceptor belt 120 by exposing the surface of the photoreceptor belt 120 to a pattern of light corresponding to that color's image pattern and erasing the corresponding electrical charges.

Each of the image forming stations 140, 150, 160 and 170 includes developing material applicators 144, 154, 164 and 174, respectively. Each developing material applicator 144, 154, 164 or 174 applies a different color toner to a corresponding electrostatic latent image on the photoreceptor belt 120. For example, the developing material applicator 144 may apply cyan colored toner, while the developing material applicator 154 may, for example, apply magenta colored toner. Each toner is made up of toner particles and liquid carrier. In "write white" systems employing charged area development (CAD) the toner particles are charged to a polarity opposite in polarity to the charged latent image on the photoreceptor belt 120. In "write black" systems employing discharged area development (DAD) the toner particles are charged with the same polarity as the charged areas of the photoreceptor and are developed only onto the discharged areas. In either CAD or DAD, the toner particles develop the electrostatic latent image on the photoreceptor belt 120, creating a visible image.

After each developed image is formed, the charging, imaging and developing steps are repeated for the subsequent color-separated images by recharging and re-exposing the photoreceptor belt 120 so that a next latent color image is superimposed over the previously developed color image.

The latent image is developed as described above and the process is then repeated to create a multi-layer image that includes yellow, magenta, cyan and black toner particles as provided by the image forming stations 140, 150, 160, and 170. It is important to note that the color of toner of each of the image forming stations 140, 150, 160 and 170 could be provided in a different arrangement than that described above.

Once a multi-layer image is formed on the photoreceptor belt 120, the photoreceptor belt 120, which carries the multi-layer image, is advanced to an intermediate transfer station 180. At the intermediate transfer station 180, a charging device 182 generates a charge to electrostatically transfer the multi-layer image from the photoreceptor belt 120 to an intermediate transfer member 184. The intermediate transfer member 184 may be either a rigid roll or an endless belt, as shown in FIG. 1.

Once the multi-layer image is transferred from the photoreceptor belt 120 to the intermediate transfer member 184, the intermediate transfer member 184 is then transferred to a transfix region 186, where the multi-color image is transferred to a recording sheet 190 that is also transported through the transfix region 186. The toner particles are forced into contact with the surface of the recording sheet 190 by a force applied by a pair of pressure rollers 188 and 189. As a result, the image is transferred onto a recording sheet. One or both of these rollers may also be heated to melt the toner particles and enhance their transfer to the recording sheet.

As described above, the downstream developing supply reservoirs can become contaminated with other colors from previously developed images when subsequent images are developed. This occurs because the toner of a first color applied to the photoreceptor belt 120, to produce a first color developed image, may separate, or "detone", from the photoreceptor belt 120 during subsequent processing. This detoned toner may become captured or retrieved by direct development of a subsequent color. In this case, the first color toner particles become incorporated into and contaminate the toner of a different downstream color.

Figure 2:
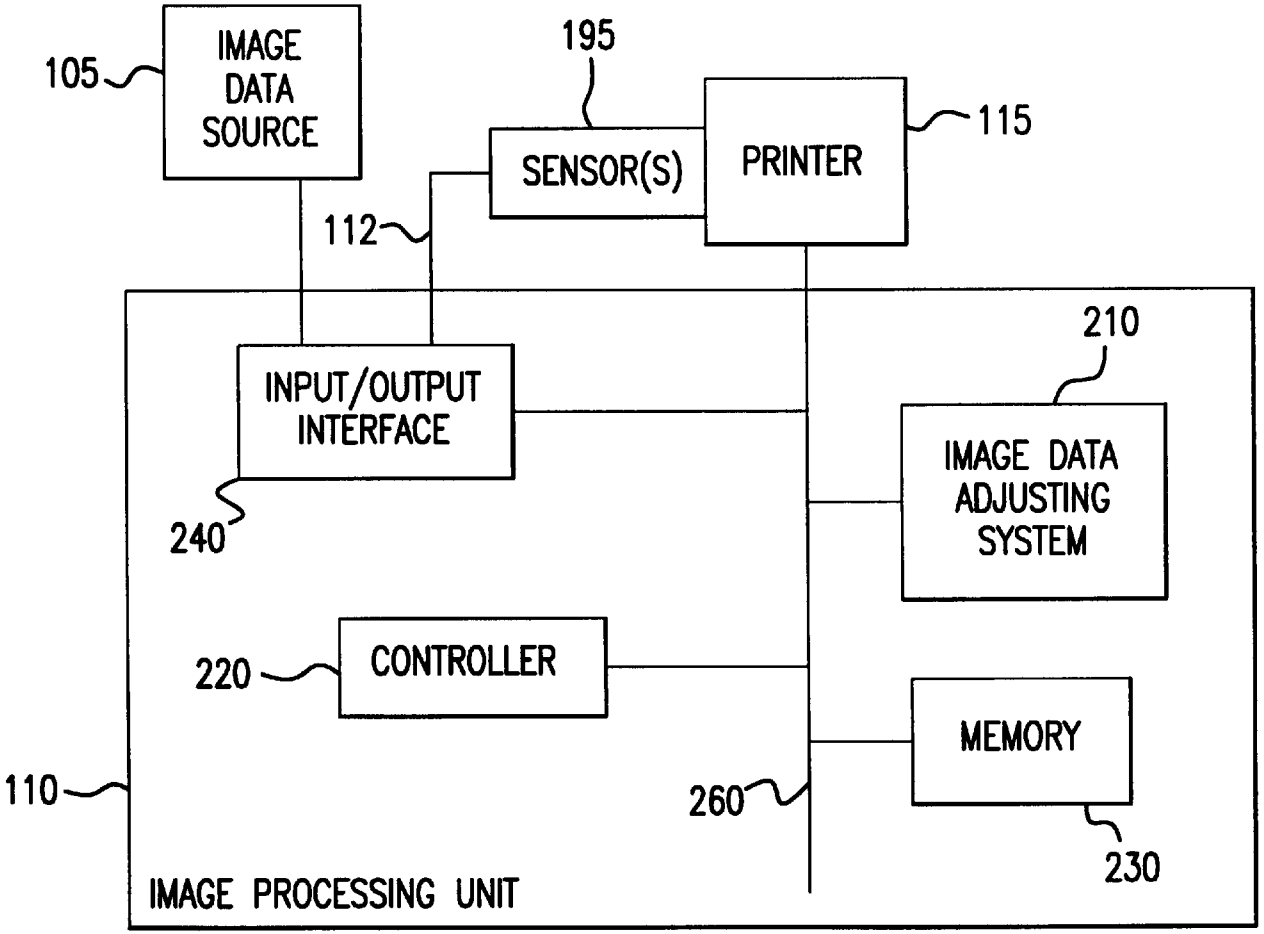
FIG. 2 is a block diagram of the image data adjusting system according to the invention.

FIG. 2 shows one exemplary embodiment of a generalized functional block diagram of the image processing unit 110, including the image data adjusting system 210 according to the invention. The image processing unit 110 includes the image data adjusting system 210, a memory 230, a controller 220 and an input/output interface 240. The image data adjusting system 210, the memory 230 and a controller 220 are interconnected via a control and/or data bus 260. The image data source 105 is connected to the control and/or data bus 260 through the input/output interface 240. The image forming stations 140–170 are connected to the image processing unit 110 over a signal line 112.

FIG. 2 also shows the image processing unit 110 connected to the image data source 105, over the signal line or link 102, that provides the image data. In general, the image data source 105 can be any one of a number of different sources, such as a scanner, a digital copier, a facsimile device that is suitable for generating electronic image data, or a device suitable for storing and/or transmitting electronic image data, such as a client or server of a network, or the Internet, and especially the World Wide Web. Thus, the image data source 105 can be any known or later developed source that is capable of providing image data to the image processing unit 110.

In operation, the image data source 105 provides image data to the image processing unit 110 through the input/out interface 240. The image data is then stored in the memory 230. The at least one sensor 195 then determines the level of contamination by upstream toners in each of the downstream toner reservoirs, for example, in each of magenta, yellow and black reservoirs when the printing order is cyan, magenta, yellow and black. The contamination information is received by the image processing unit 110 under control of the controller 220 and is stored in the memory 230. The image data adjusting system 210, under control of the controller 220, adjusts the image data for each color separation layer based on the contamination information stored in the memory 220. The controller 220 then sends the adjusted image data to the appropriate image forming stations 140–170. The appropriate image forming stations 140–170 form the various color separated images based upon the adjusted image data.

Figure 3:
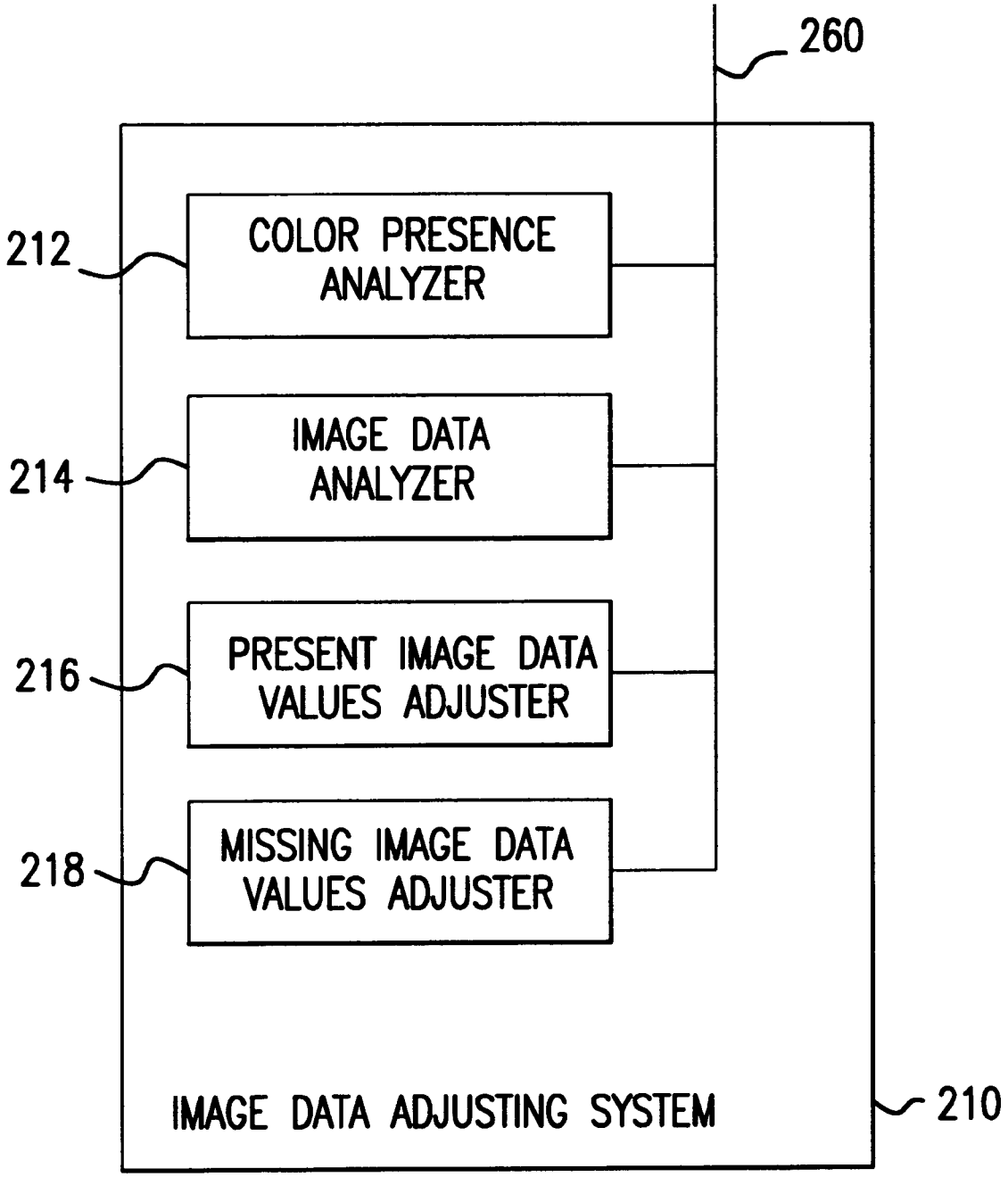
FIG. 3 is a block diagram of the image data adjusting system according to the invention.

FIG. 3 shows in greater detail one exemplary embodiment of the image data adjusting system 210. As shown in FIG. 3, the image data adjusting system 210 includes a color presence analyzer 212, an image data analyzer 214, a present contaminated data values adjuster 216 and a missing contaminated data values adjuster 218.

In operation, the image data adjusting system 210 inputs the image data received from the image data source 105 and stored in the memory 230. The at least one sensor 195 provides the contamination information to the image data adjusting system 210. The contamination information is directed from the at least one sensor 195 to the color presence analyzer 212. The color presence analyzer 212 determines the level of contamination in the toner reservoirs, as described above, based on the contamination information.

The image data analyzer 214 then analyzes the image data received from the image data source 105 to determine whether the next portion of image data to be printed will require a contaminated toner. If the next portion of image data requires printing with a contaminated toner, the image data analyzer 214 analyzes the image data to determine whether the image also requires printing with the contaminating toner and/or printing with toners complimentary to the contaminating toner. If the next image data to be printed requires using both the contaminated toner and the contaminating toner, the present contaminated data values adjuster 216 is used to adjust the image data. The present contaminated data values adjuster 216 adjusts the image data for both the contaminated and contaminating toners based on the contamination information from color presence analyzer 212, so that the printed image is the desired color and does not reflect the contamination.

In contrast, if the next portion of image data to be printed requires using a contaminated toner but does not require using the contaminating toner that is contaminating that contaminated toner, then the missing contaminated data values adjuster 218 is used. The missing contaminated data values adjuster 218 adjusts the image data to print a compensating toner that compensates for the contaminating toner in the contaminated toner to be printed. Thus, the image data adjusting system 210 adjusts the image data to compensate for toner contamination when the next image data to be printed requires using a contaminated toner whether or not the next image data requires using the contaminating toner.

This exemplary embodiment of the image data adjusting systems and methods can be applied to a four-color toner printing system. For example, in a four-color printing system, the at least one sensor 195 outputs one or more signals indicating the level of contamination by the first and/or second and/or third toners in the second and/or third and/or fourth toner reservoirs. The color presence analyzer 212 analyzes the contamination information from the at least one sensor 195. Specifically, in this exemplary embodiment, the color presence analyzer 212 determines whether the second toner is contaminated with the first toner, whether the third toner is contaminated with either or both of the first and second toner, and whether the fourth toner is contaminated by any or all of the first three toners. If no toner is contaminated, the image data is not altered and the image is printed with the first-fourth color toners.

Initially, if one or more of the second, third or fourth toner reservoirs is contaminated, the image data analyzer 214 determines if a next portion of the image data requires using the third or fourth toners. If the next portion of the image data does not require using the third or fourth toners, the image data analyzer 214 determines if the image data requires using the second toner. If the image data does not require using the second or third or fourth toner, the image data is printed without adjusting it due to contamination.

If the image data requires using the second toner, then, if the color presence analyzer 212 determines that one or more of the second or third toner reservoirs is contaminated, the image data analyzer 214 analyzes the image data to determine whether the image data to be printed requires using both the contaminated toner and the contaminating toner. That is, the image data analyzer 214 determines for example, whether the first and second toner are to be printed when the second toner is contaminated with the first toner, whether the second and third toner are to be printed when the third toner is contaminated with the second toner, whether the first and third toner are to be printed when the third toner is contaminated with the first toner, or whether the third and one or both of the first and second toner are to be printed when the third toner is contaminated with both the first and second toner. If the image data analyzer 214 determines that the image data requires using a contaminated toner but not the contaminating toner, such as, for example, the second toner but not the first toner when the second toner is contaminated with the first toner, the third toner but not the first toner when the third toner is contaminated only with the first toner, or the third toner but not the second toner when the third toner is contaminated only with the second toner, the image data analyzer 214 further analyzes the image data to determine if the image data requires using the fourth toner.

If the image data to be printed requires using both the first and second toner, and only the second toner is contaminated with the first toner, the present contaminated color image data values adjuster 216 adjusts the image data for both the first and second toners based on the contamination level of the first toner in the second toner detected by the at least one sensor 195. In particular, the present contaminated color image data values adjuster 216 reduces the image data values for the first toner and increases the image data values for the second toner.

If, however, the image data to be printed does not require using the contaminating first toner, and only the second toner reservoir is contaminated, the missing contaminated color image data values adjuster 218 adjusts the image data for the second toner and the third toner, and possibly the fourth toner, if the fourth toner is required, to compensate for the contaminating first toner. In particular, if the image data requires printing only the second toner, but not the contaminating first toner, the missing contaminated data values adjuster 218 increases the image values for the contaminated second toner, and increases the image data values for the third toner from data values of zero to positive values. Furthermore, if the image data requires printing the second and fourth toner, the missing contaminated data values adjuster 218 further reduces the image data values for the fourth toner, in addition to increasing the image data values for the second and third toner.

In contrast, if the image data analyzer 214 determines that the image data requires using the third toner, the image data analyzer 214 then determines if the image data requires using the first toner, the second toner, or both the first and second toners. At the same time, the color presence analyzer 212 determines if the third toner is contaminated with the first toner, the second toner, or both the first and second toners.

If the image data requires printing both the second and third toners but the third toner is not contaminated, the missing contaminated data values adjuster 218 increases the image data values for the second toner to compensate for any contamination by the first toner in the second toner reservoir as described above, and increases the image data values for the third toner. If the image data further requires printing using the fourth toner, the missing contaminated image data values adjuster 218 also reduces the image data values for the fourth toner. The image is then printed using the compensated image data for the second and third toner, and possibly the fourth toner.

If the image data analyzer 214 determines that the image data requires printing only the first and third toner, and possibly the fourth toner, and the color presence analyzer 212 determines that the third toner is contaminated only with the first toner, the image data is adjusted by the present contaminated data adjuster 216 as described above with respect to the second toner being contaminated with the first toner. Otherwise, if the color presence analyzer 212 determines that the third toner is contaminated only with the second toner, the image data is adjusted by the missing contaminated data values adjuster 218 as described above with respect to the first and second toner.

Similarly, if the image data analyzer 214 determines that the image data requires printing only the second and third toner, and possibly the fourth toner, in the color presence analyzer 212 determines that the third toner is contaminated with the second toner, the image data is adjusted by the present contaminated data values adjuster 216. Otherwise, if the color presence analyzer 212 determines that the third toner is contaminated only with the first toner, the image data is adjusted by the missing contaminated image data values adjuster 218 as described above.

If the image data analyzer 214 determines that the image data requires using the first, second and third toner, and the color presence analyzer 212 determines that the third toner is contaminated with only one of the first and second toners, then the image data is adjusted by the present contaminated data values adjuster 216 to adjust the image data values for the third toner and the contaminating one of the first and second toners as described above. Importantly, the image data values for the other of the first and second toners are not adjusted.

If the color presence analyzer 212 determines that the third toner is contaminated with both the first and second toner, the color presence analyzer 212 further determines which of the first and second toner is the predominant contaminant. Because the first, second and third toners, when combined together in roughly equal proportions, form process black, the result of contaminating the third toner with both the first and second toner is equivalent to contaminating the third toner with an amount of black toner equivalent to the amount of contaminating toner present in the third toner for the non-predominant contaminant. This also effectively reduces the amount of the amount of predominant contaminant and the amount of the third toner in the third toner reservoir by an amount equal to the non-predominant contaminant. The third toner reservoir is thus effectively contaminated with an amount of contaminating toner of the predominant contaminant that is equal to the difference in the amounts of the first and second contaminating toner in the third toner and an amount of process black. Thus, the image data can be adjusted as if the third toner were only contaminated with the predominant one of the first and second toner and the fourth toner.

For example, if the first toner is the predominant contaminant, the image data can be adjusted as described above as if the third toner were contaminated only with the first and fourth toners. Similarly, if the second toner is the predominant toner, the image data values can be adjusted as described above as if the third toner were contaminated only with the second and fourth toners.

In addition, in this case, if the image data also requires using the fourth toner, which is usually black, the image data values for the fourth toner should be reduced by either of the present contaminated data values adjuster 216 or the missing contaminated data values adjuster 218 by an amount equal to the amount of contaminating toner for the non-predominant contaminant in the third toner.

It should be understood that each circuit shown in FIGS. 2 and 3 can be implemented as portions of a suitably programmed general purpose computer. Alternatively, each of the circuits shown in FIGS. 2 and 3 can be implemented as physically distinct hardware circuits within an ASIC, or using a FPGA, a PDL, a PLA or a PAL, or using discrete logic elements or discrete circuit elements. The particular form each circuit shown in FIGS. 2 and 3 will take is a design choice and will be obvious and predicable to those skilled in the art.

While FIGS. 1 and 2 show the printing system 100 as a separate from the image data source 105, image data source 105 may be integrated with the printing system 100, such as in a digital copier, a computer with a built-in printer, or any other integrated device that is capable of producing a hard copy image output. With such a configuration, for example, the image data source 105, the image processing unit 110, the printing system 100 and the sensor 195 may be contained within a single device.

Furthermore, the image data adjusting system 210 may be implemented as software executing on the image processing unit 110 or the image data source 105. The sensor 195 may be incorporated into the printing system 100 or may be implemented as a stand-alone device that communicates the detected data back to the image data adjusting system 210. Other configurations of the elements shown in FIGS. 1 and 2 may be used without departing from the spirit and scope of this invention.

Figure 4:
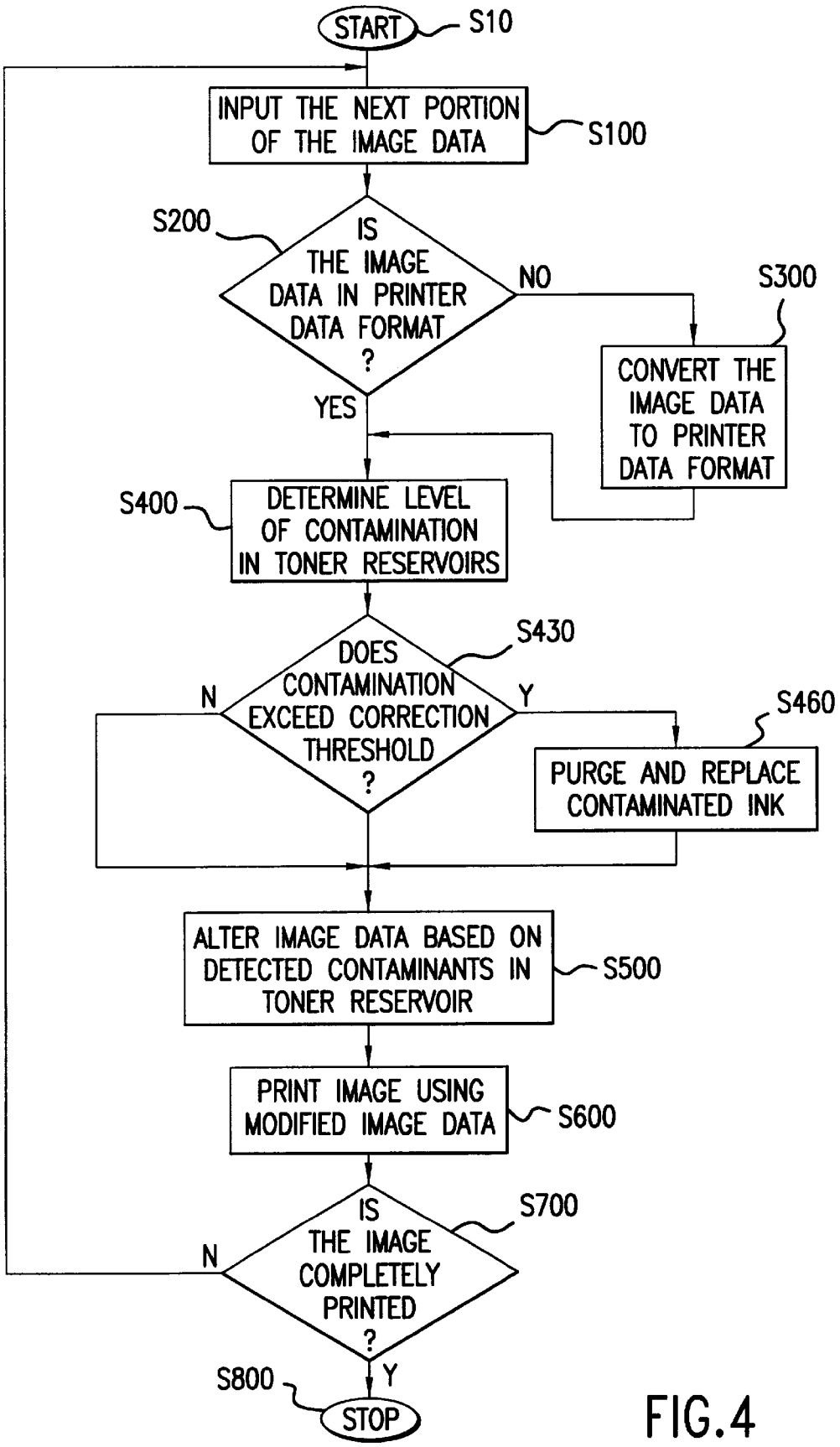
FIG. 4 is a flowchart outlining one exemplary embodiment for printing a color image by modifying the image data to compensate for contamination of downstream reservoirs by upstream toner according to this invention.
Figure 5A:
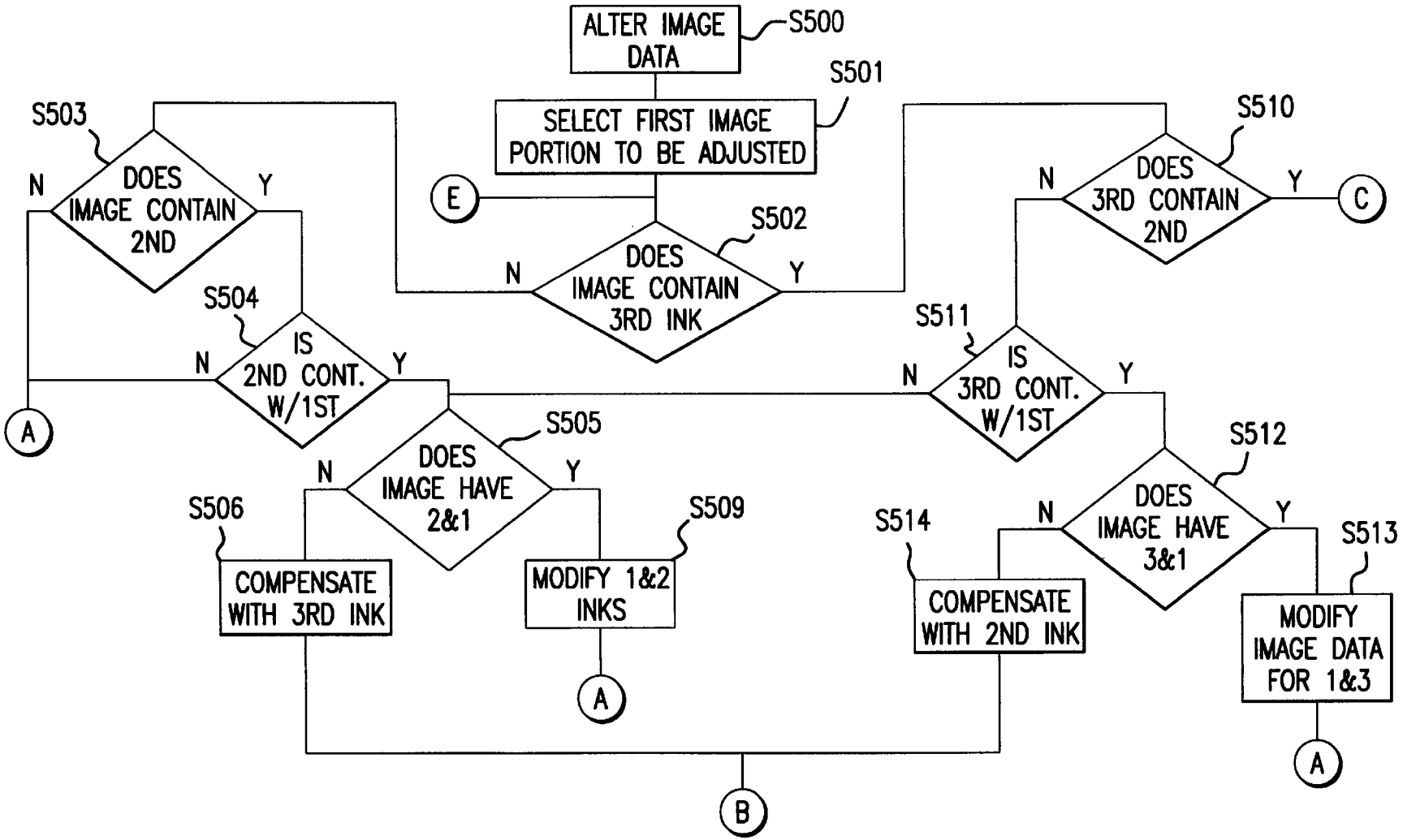
FIGS. 5A–D are a flowchart outlining in greater detail one exemplary method for adjusting the image data of FIG. 4.
Figure 5B:
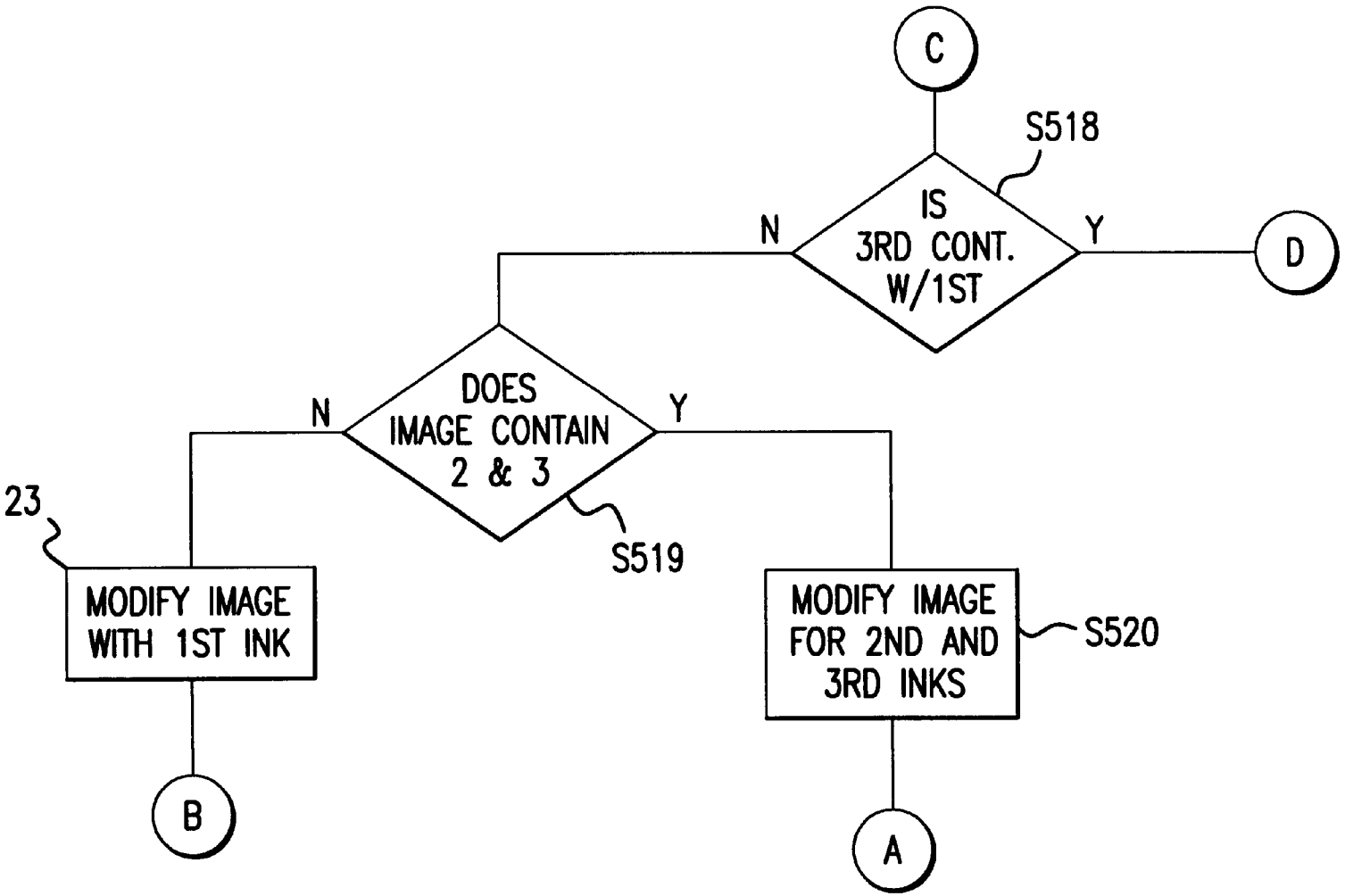
Figure 5C:
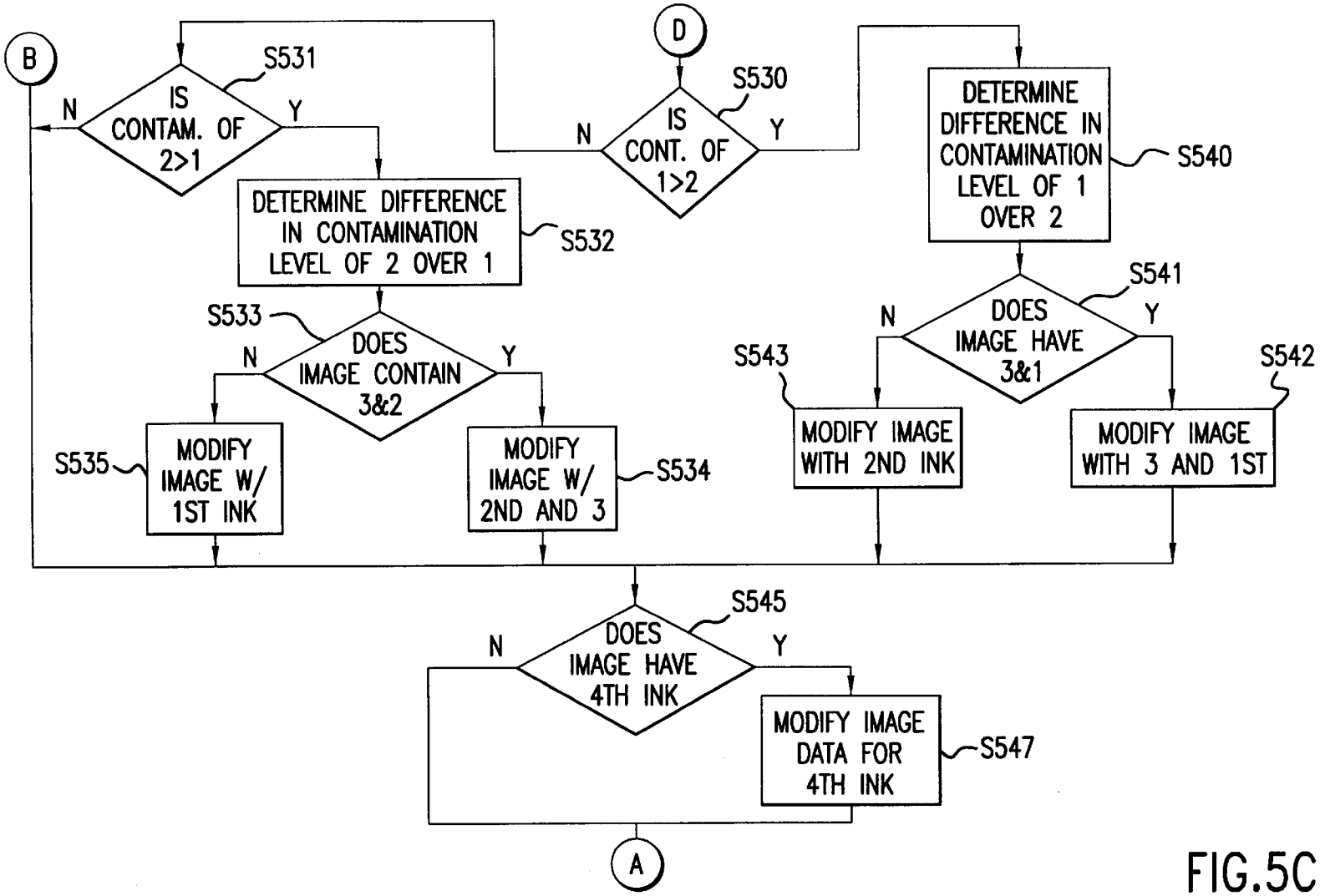
Figure 5D:
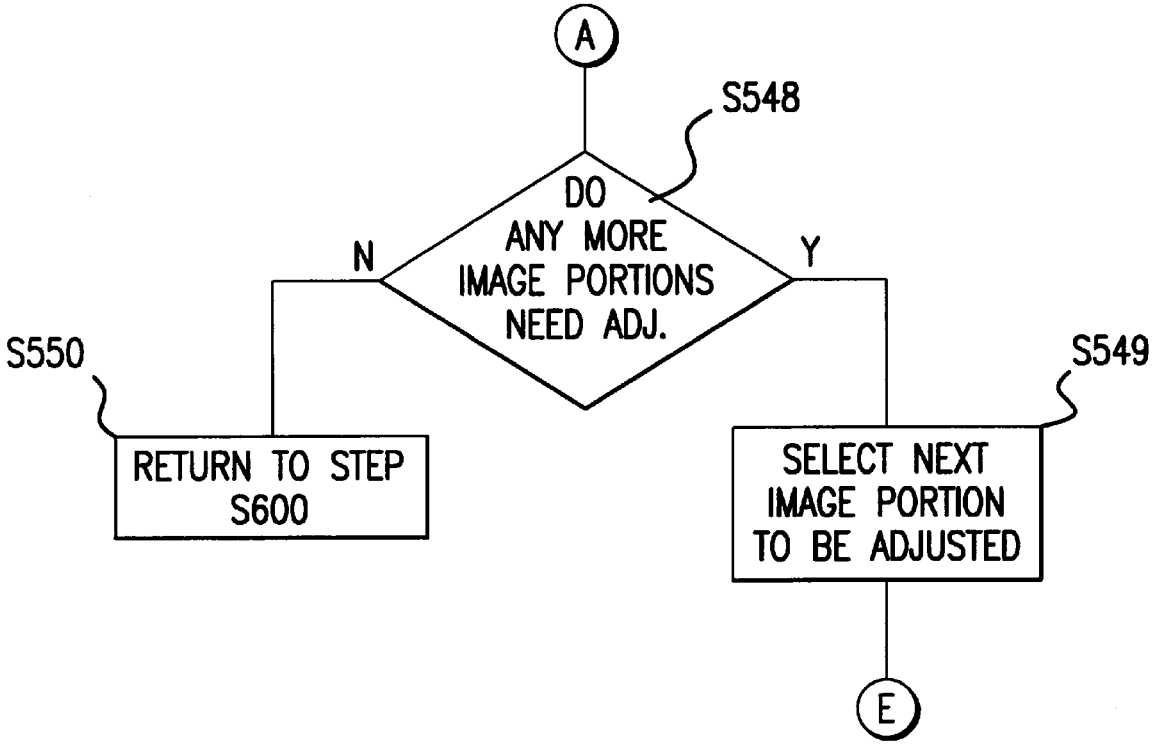

FIG. 4 is a flowchart outlining one exemplary embodiment of a method for adjusting image data based upon upstream contaminants in a downstream reservoir according to the invention. As shown in FIG. 4, beginning in step S10, control continues to step S100, where, multi-color image data is input. The image data may be received in any known format, and in any color-space, including grayscale or binary halftoned format. Next, in step S200, the image data is analyzed to determine whether it is in a printer-executable format, such as, for example, on-off writing signals for C, M, Y, K colors. If the image data is not in printer readable format, control continues to step S300. Otherwise, control jumps directly to step S400. In step S300, the image data is converted into a printer-executable format. Control then continues to step S400.

In step S400, the level of contamination in each of the different toner reservoirs is determined. Control then goes to step S430. In step S430, the level of contamination of the toners is analyzed to determine whether it is too great for the compensation methods to print acceptable matches to the input color. If the level of contamination is not too high for the compensation methods to operate, control jumps continues to step S500. However, if the level of contamination of the toners is too high for the compensation methods according to the invention to print acceptable matches to the input color, control continues to step S460.

In step S460, the contaminated toner is purged from the toner reservoir and the toner is replaced with fresh toner. Alternatively, some of the contaminated toner is drained while fresh toner is trickled into the toner reservoir. Control then goes to step S500.

Then, in step S500, the image data is adjusted based upon the detected impurities in the different ink reservoirs. Thus, the image data is altered so that the amount of toner used to form an image is also altered to compensate for contamination in the different toner reservoirs. Control then continues to step S600.

In step S600, the image is printed using the adjusted image data. Then, in step S700, the image data is analyzed to determine if the image is completely printed. If the image is not completed, control returns to step S100. Otherwise, if the image is completely printed, control proceeds to step S800, where the process ends.

FIGS. 5A–5D are a flowchart outlining in greater detail one exemplary embodiment of a method for adjusting the image data based on the detected impurities of step S500. Beginning in step S500, control continues to step S501, where the first image portion to be adjusted is selected. Then, in step S502, the first portion of image data is analyzed to determine if the third toner is required. If using the third toner is required, control jumps to step S510. Otherwise, control continues to step S503.

In step S503, the selected portion of the image data is analyzed to determine whether the second toner is required. If the second toner is not required, control jumps to step S548. However, if the second toner is required, control continues to step S504.

In step S504, the second toner is analyzed to determine if it is contaminated with the first toner. If the second toner is not contaminated with the first toner, control jumps to step S548. Otherwise, control continues to step S505.

In step S505, the selected image data portion is analyzed to determine whether it requires using both the first and second toners. If the selected image data portion requires using the second toner, but not the first toner, control continues to step S506. If the selected image data portion requires using both the first and second toners, control jumps to step S509.

In step S506, the image data is modified to require using the compensating third toner. Control then jumps to step S545 because the combination of the contaminated second toner and the third toner will result in the formation of process black, making the print color darker than desired.

In contrast, in step S509, the selected image data portion for both the first and second toners is modified to compensate for the contaminating first toner in the second toner. Control then jumps to step S548.

In step S510, the third toner is analyzed to determine whether it is contaminated with the second toner. If the third toner is contaminated with the second toner, control jumps to step S518. However, if the third toner is not contaminated with the second toner, control continues to step S511. In step S511, the third toner is analyzed to determine whether it is contaminated with the first toner. If the third toner is not contaminated with the first toner, control jumps back to step S504. However, if, in step S511, the third toner is determined to be contaminated with the first toner, control continues to step S512.

In step S512, the selected image data portion is analyzed to determine whether the image data requires using both the third and first toners. If the selected image data portion does not require using both the first and third toners, control jumps to step S514. Otherwise, if the image requires using both the first and third toners, control continues to step S513. In step S513, the selected image data portion corresponding to the first and third toner is modified. Control then jumps to step S548.

In contrast, in step S514, the selected image data portion is modified to require using a sufficient quantity of the compensating second toner to compensate for the contaminating first toner. Control then jumps to step S545 because the combination of the contaminated third toner and the second toner will result in the formation of process black, making the print color darker than desired.

In step S518, the third toner is analyzed to determine whether the third toner is also contaminated with the first toner. If the third toner is also contaminated with the first toner, control jumps to step S530. If, however, the third toner is contaminated with the second toner but is not contaminated with the first toner, control continues to step S519.

In step S519, the selected image data portion is analyzed to determine whether the image data requires using both the second and third toners. If the selected image data portion requires using both the second and third toners, control jumps to step S520. Otherwise, if the selected image data portion does not require using both the second and third toners, control jumps to step S523.

In step S520, the image data corresponding to the second and third toners is modified. Control then jumps to step S548. In contrast, in step S523, the image data is modified to require using the compensating first toner. Control then jumps to step S545, because the compensating first toner results in the formation of process black, making the print color darker than desired.

In step S530, the third toner is analyzed to determine whether the first toner or the second toner is the predominant, i.e., greater, contaminant. Thus, in step S530, if the third toner is determined to be contaminated with a greater quantity of the first toner than the second toner, control jumps to step S540. Otherwise, if, in step S530, the contamination of the third toner with the first toner is determined to be less than or equal to the contamination of the third toner with the second toner, control continues to step S531.

In step S531, the third toner is analyzed to determine whether it is contaminated with a greater quantity of the second toner than the first toner. If the contamination of the third toner with the second toner is greater than the contamination of the third toner with the first toner, control continues to step S532. However, in step S531, if the third toner is determined to be contaminated with equal portions of the first and second toners, control jumps to step S545.

In step S532, the difference between the amount of contamination of the second toner over the amount of contamination of the first toner is determined. This difference represents the amount of contaminating second toner that is not inherently compensated for by the contaminating first toner. Then, in step S533, the selected image data portion is analyzed to determine whether the image data requires using both the third and second toner. If the image data requires using both the third and second toners, control continues to step S534. Otherwise, if the image data does not require using both the third and second toners, control jumps to step S535. In step S534, the selected image data portion corresponding to the second and third toner is modified to fully compensate for the amounts of the contaminating first and second toner. Control then jumps to step S545.

In contrast, in step S535, the image data is modified to require using the compensating first toner to fully offset the determined difference in the contaminating first and second toners in the third toner. Control jumps to step S545.

In step S540, the difference between the amount of contamination of the first toner over the amount of contamination of the second toner is determined. This difference represents the amount of contaminating first toner that is not inherently compensated for by the contaminating second toner. Then, in step S541, the selected image data portion is analyzed to determine whether the image data requires using both the third and first toners. If the image data requires using both the first and third toners, control continues to step S542. If, however, the image data does not require using both the third and first toners, control jumps to step S543.

In step S542, the image data corresponding to the first and third toners is modified. Control then jumps to step S545. In contrast, in step S543, the image data is modified to require using the compensating second toner. Control then continues to step S545.

Step S545 is reached from steps S506, S514, S523, S534, S535, S542 and S543. The combination of the contaminated toner and the compensating toner results in the formation of process black, making the print color darker than desired. Therefore, if the image requires using the fourth toner, the image data for the fourth toner should be modified to compensate for this darkening. According, in step S545, the selected image data portion is analyzed to determine whether the fourth toner is required. If the fourth toner is not required, control jumps to step S548. If, however, the fourth toner is required, control continues to step S547.

In step S547, the image data corresponding to the fourth toner is modified to compensate for the total amount of the first, second and third toners required by the modified image data that is combining to form process black. Control then jumps to step S548.

In step S548, the image data is analyzed to determine if there are any more portions of the image data to be analyzed. If no, control jumps to step S550. Otherwise, control continues to step S549, where the next image portion is selected. Control then jumps back to step S502. In contrast, in step S550, control returns to step S600.

The exemplary embodiment of the invention described above uses four toners. These toners may be of any known or later developed color format, such as the CMYK format. The different colors of the four toners may be ordered in any arrangement without affecting the method described above, although these exemplary embodiments of the systems and methods of this invention assume that the fourth toner is the black toner. Further, the systems and methods of this invention can be adapted to printer systems with more than four differently colored toners. Thus, the exemplary embodiments of the systems and methods of this invention described above are not meant to restrict the number of toner colors that can be managed and adjusted by the systems and methods of this invention.

In the examples described below, the printer system is a four-color toner printer which prints in the order CMYK. The image data adjusting system 210 adjusts the image data of the image based on the last measurement of the actual color of the toners. The image data adjusting system 210 first determines whether the image to be printed contains both the contaminating color and the contaminated color. Thus, if yellow toner is contaminated with a few percent of cyan toner, then the contaminated yellow toner actually contains less yellow toner and some cyan toner. Thus, in order to compensate for this contamination of the yellow toner, the image data is altered so that more yellow toner is printed and less cyan toner is printed. If the contaminated yellow toner contains 95% yellow toner and 5% cyan toner, the image areas that normally contain 50% cyan toner and 50% yellow toner must be adjusted to contain [50+(5*50)/(100−5)]% contaminated yellow toner and [50−(5*50)/(100−5)]% cyan toner. Thus, the image data is adjusted to print 52.63% contaminated yellow toner and 47.37% cyan toner. This adjustment results in printing the desired image, which contains 50% yellow toner and 50% cyan toner, as [52.63%×0.95]=50% yellow toner and [47.37%+(52.63%×0.05)]=50% actual cyan toner. In this example, the next portion of image data to be printed requires using the contaminated color, but none of the contaminating color. In this case, a color that complements the contaminating color is added to compensate for the toner contamination. In addition, any black toner that would have been printed is reduced. If yellow toner is contaminated with cyan toner, then the image data is adjusted to print a few extra percent of magenta toner in subsequent yellow, orange and red images. The extra magenta toner compensates for the cyan toner contamination and shifts the color of the printed image closer to the desired value. However, the cyan toner contaminant and the extra compensating magenta combine with the yellow toner to make the printed color darker than desired. If the desired color contains no black, this darkening is undesirable. However, color darkening is generally less objectionable a shift in the hue of the color. An advantage of this invention is that it can estimate the darkening that will be produced in such cases. The control system of this invention can include rules which signal the point at which contamination has become too great for compensation to produce acceptable results. Such rules might include limits of the darkening of some set of colors.

If the image data also indicates that black toner is to be printed, the amount of black toner to be printed should be reduced to compensate for this darkening. If the yellow toner supply contains 95% yellow toner and 5% cyan toner, then, using the assumption as and formulas previously given, areas that would normally contain 25% magenta toner, 50% yellow toner and 25% black toner could be modified to contain [25+(5*(50+(2*50*5)/(100−2*5)))]% magenta toner, [50+(2*50*5)/(100−5)]% yellow toner and [25−(5*(50+(2*5*50)/(100−2*5)))]% black toner. Thus, the image data is adjusted to print 55.26% contaminated yellow toner, 27.78% magenta toner and 22.22% black toner. This adjustment results in printing the desired image, which contains 52.50% yellow toner, 2.76% cyan toner (=55.26*0.05), 27.78% magenta toner and 22.22% black toner, where the 2.78% cyan toner combines with equal amounts of the magenta and yellow toners to replace approximately 2.78% process black.

While this invention has been described in conjunction with specific embodiments thereof, it will be understood that many alternatives, modifications and variations will be apparent to those skilled in the art. Accordingly, the invention is intended to embrace all such alternatives, modifications, and variations as fall within the spirit and broad scope of the appended claims.

What is claimed is:

1. A method for adjusting image data to compensate for contamination of a first toner into a second toner, comprising:

detecting contamination of at least the first toner in at least the second toner;

adjusting the image data based upon the detected contamination.

2. The method of claim 1, further comprising detecting contamination of a third toner by the at least one of the first and second toners.

3. The method of claim 2, further comprising:

determining whether an image portion to be printed requires using a contaminated toner and a contaminating toner, wherein if the image requires using the contaminated and contaminating toners, adjusting the image data comprises adjusting portions of the image data corresponding to the first and second toners to compensate for the amount of contaminating toner in the contaminated toner portion.

4. The method of claim 3, wherein if the image portion requires using the contaminated but not the contaminating toners, adjusting the image data comprises adjusting portions of the image data to use a compensating toner to compensate for the amount of contaminating toner in the contaminated toner.

5. The method of claim 1, further comprising:

determining whether an image portion to be printed requires using a contaminated toner and a contaminating toner;

wherein if the image requires using the contaminated and contaminating toners, adjusting the image data comprises adjusting portions of the image data corresponding to the first and second toners to compensate for the amount of contaminating toner in the contaminated toner portion.

6. The method of claim 5, wherein if the image portion requires using the contaminated but not the contaminating toners, adjusting the image data comprises adjusting portions of the image data to use a compensating toner to compensate for the amount of contaminating toner in the contaminated toner.

7. The method according to claim 1, further comprising the step of determining whether the contamination of the toners exceeds a threshold level preventing adjusting of the image data.

8. The method according to claim 7, further comprising the step of toner replenishing if the determining step determines that the contamination exceeds a threshold level preventing adjusting of the image data.

9. The method according to claim 8, wherein the toner replenishing step comprises:

draining the contaminated toner from an toner reservoir; and replacing the contaminated toner with fresh toner.

10. The method according to claim 8, wherein the toner replenishing step comprises:

draining a portion of the contaminated toner based upon the level of contamination of the contaminated toner;

replacing the portion of the contaminated toner with fresh toner.

11. The method according to claim 1, wherein the detecting step uses a spectrophotometric sensor.

12. The method according to claim 11, wherein the spectrophotometric sensor measures colors of the toner or toners used to print an image.

13. The method according to claim 12, wherein the spectrophotometric sensor measures transmission spectra of the toner or toners used to print an image.

14. The method according to claim 12, wherein the spectrophotometric sensor measures reflection spectra of the toner or toners used to print an image.

15. The method of claim 11, wherein the spectrophotometric sensor measures colors of printed areas on a final copy sheet.

16. The method according to claim 11, wherein the spectrophotometric sensor measures colors of test patches printed with the toner or toners used to print an image.

17. An image data adjustment system which compensates for contamination of a first toner into a second toner, comprising:

a sensor for detecting contamination of at least a first toner into at least a second toner;

an image data source;

an image data adjusting circuit which adjusts image data from the image data source based upon the contamination detected by the sensor.

18. The image data adjustment system according to claim 17, wherein the sensor detects contamination of a third toner by at least one of the first and second toners.

19. The image data system according to claim 17, wherein the image data adjusting circuit further comprises:

a color presence analyzer for determining the level of contamination in at least one of the first or second toners;

an image data analyzer which analyzes the image data from the image data source to determine whether an image to be printed requires printing with a contaminated and a contaminating toner;

a present contaminated data values adjustment circuit which adjusts the image data for both the contaminated and contaminating toner if the image data analyzer determines that the image to be printed requires both the contaminated and contaminating toners; and a missing image data values adjustment circuit which adjusts the image data to print a compensating toner that compensates for the contaminating toner if the image data analyzer determines that the image to be printed requires the contaminated toner, but not the contaminating toner.

20. The image data system according to claim 17, further comprising a threshold detecting sensor that detects whether the contamination of the toners exceeds a threshold level preventing adjusting of the image data by the image data adjusting circuit.

21. The image data system according to claim 20, wherein the threshold detecting sensor sends control signals to a toner replenishment device if the contamination of the toners exceeds the threshold level preventing adjusting of the image data by the image data adjusting circuit.

22. The image data system according to claim 21, wherein the toner replenishment device drains contaminated toner from a toner reservoir and replaces the contaminated toner with fresh toner.

23. The image data system according to claim 17, wherein the sensor is a spectrophotometric sensor.

24. The image data system according to claim 23, wherein the spectrophotometric sensor measures colors of the toner or toners used to print an image.

25. The image data system according to claim 24, wherein the spectrophotometric sensor measures transmission spectra of the toner or toners used to print an image.

26. The image data system according to claim 24, wherein the spectrophotometric sensor measures reflection spectra of the toner or toners used to print an image.

27. The image data system of claim 23, wherein the spectrophotometric sensor measures colors of printed areas on a final copy sheet.

28. The image data system according to claim 23, wherein the spectrophotometric sensor measures colors of test patches printed with the toner or toners used to print an image.

* * * * *